United States Patent [19]

Brown

[11] Patent Number: 4,767,275

[45] Date of Patent: Aug. 30, 1988

[54] LOCKING PIN SYSTEM FOR TURBINE CURVED ROOT SIDE ENTRY CLOSING BLADES

[75] Inventor: Wilmott G. Brown, Winter Park, Fla.

[73] Assignee: Westinghouse Electric Corp., Pittsburgh, Pa.

[21] Appl. No.: 884,826

[22] Filed: Jul. 11, 1986

[51] Int. Cl.[4] ..... F01D 5/32

[52] U.S. Cl. ..... 416/220 R; 416/193 A

[58] Field of Search ..... 416/193 A, 212 A, 212 R, 416/213 R, 219–221

[56] References Cited

U.S. PATENT DOCUMENTS

| | | | |
|---|---|---|---|
| 1,719,415 | 7/1929 | Back | 416/219 R |
| 1,793,468 | 2/1931 | Densmore | 416/219 R |
| 1,890,581 | 12/1932 | Köhler | 416/219 R |
| 2,431,249 | 11/1947 | Heppner | 416/217 X |
| 2,651,494 | 9/1953 | Persson | 416/220 R |
| 2,843,356 | 7/1958 | Hull | 416/220 R X |
| 2,976,014 | 3/1961 | Kress | 416/220 R |
| 3,158,353 | 11/1964 | Reid et al. | 416/220 R |
| 3,986,793 | 10/1976 | Warner et al. | 416/219 R X |

FOREIGN PATENT DOCUMENTS

| | | | |
|---|---|---|---|
| 573565 | 4/1959 | Canada | 416/220 R |
| 59398 | 5/1954 | France | 416/221 |
| 134703 | 10/1980 | Japan | 416/193 A |
| 728710 | 4/1955 | United Kingdom | 416/220 R |

OTHER PUBLICATIONS

S.A.E. Journal, Feb., 1948, pp. 32–35.

*Primary Examiner*—Everette A. Powell, Jr.
*Attorney, Agent, or Firm*—Fred J. Baehr, Jr.

[57] ABSTRACT

A redundant locking system for the closing blades of a circular array of curved Christmas tree-shaped roots of side entry freestanding steam turbine blades which have registering holes in the platform of the closing blades and the blades adjacent to the closing blades which receive pins, the pins fit tightly into the through holes and loosely into the hole in the adjacent blade to lock the closing blades in place and allow each blade to vibrate independently.

4 Claims, 2 Drawing Sheets

LOCKING PIN SYSTEM FOR TURBINE CURVED ROOT SIDE ENTRY CLOSING BLADES

BACKGROUND OF THE INVENTION

This invention relates to steam turbines and more particularly to the closing blade locking system for a circular array of curved root side entry rotating blades. Curved root side entry blades are installed in curved slots in the rotor disc one at a time and as shown in U.S. Pat. No. 3,986,793 have a pin which is installed in a notch in the platform of the blade and a groove in the disc to lock the blade in place in the disc. The next blade to be installed captures the pin preventing it from coming free. Due to the curved root, the last few blades to be installed in the array, the closing blades, cannot receive the pin which fits into the notch and groove as they must be installed in unison and often from different sides of the disc, thus requiring a special locking system.

SUMMARY OF THE INVENTION

In general, a locking pin system for freestanding closing blades of a circular array of curved side entry steam turbine blades disposed in curved slots in a disc to form a row of rotating blades, when made in accordance with this invention, comprises a plurality of side entry blades having curved root portions which are slidably received by the curved slots in the disc and each blade has a platform portion and an airfoil portion, respectively disposed radially outwardly from the root portion. The platform portion has four sides, an inlet side on the side the steam enters the blade row, an outlet side on the side the steam exits from the blade row, a forward arcuate side and a rear arcuate side, the latter two sides being relative to the direction of rotation of the blades. A hole extends from the exit side of the platform through the platform to the rear side thereof in all of the closing blades. All blades adjacent the back edge of the blade having a through hole in the platform has a blind hole disposed in the forward arcuate side thereof. The through holes and the blind holes are aligned when the blades are properly disposed in the slots and a pin fits tightly in the through hole and loosely in the blind hole with clearance on all sides of the pin in the blind hole to allow each blade to vibrate independently and provide means for locking the blades in the disc.

BRIEF DESCRIPTION OF THE DRAWINGS

The object and advantages of this invention will become more apparent from reading the following detailed description in conjunction with the accompanying drawings, in which.

DESCRIPTION OF THE PREFERRED EMBODIMENT

Figure 1:
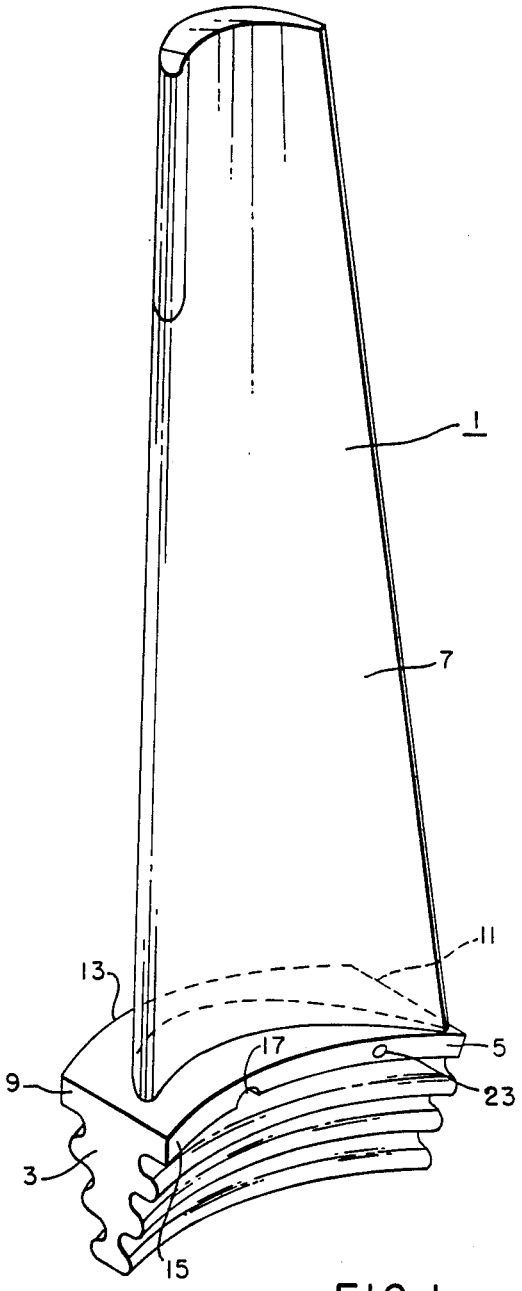
FIG. 1 is a perspective view of a curved root side entry blade made in accordance with this invention.
Figure 2:
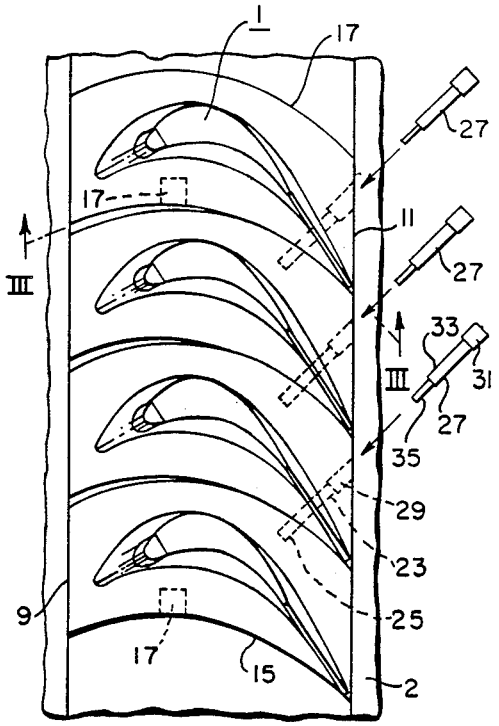
FIG. 2 is a partial elevational view of a row of side entry blades.
Figure 3:
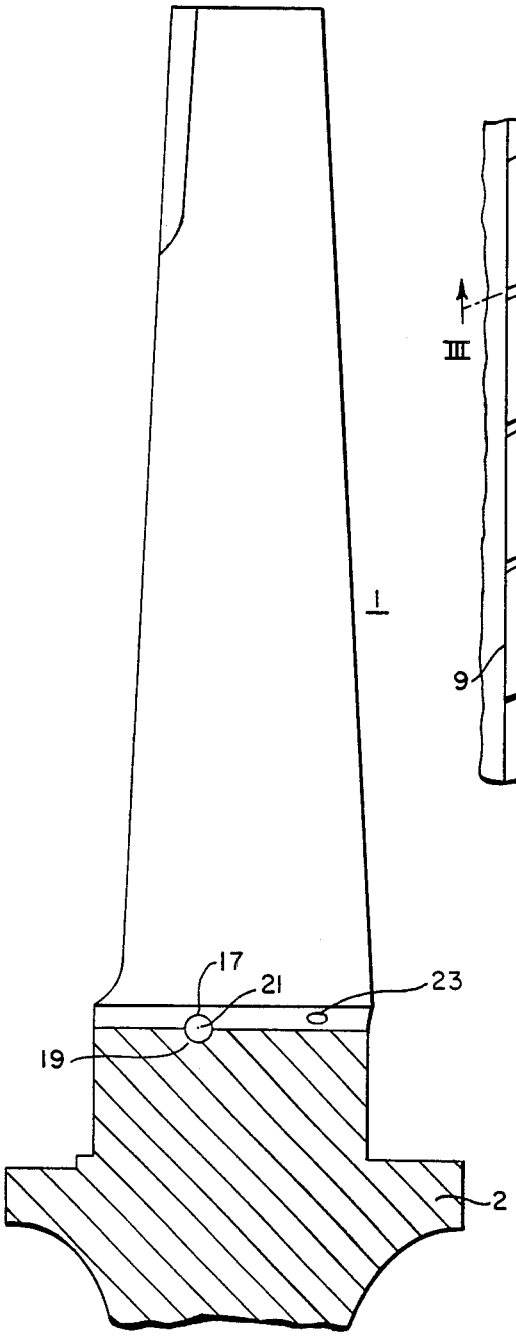
FIG. 3 is a sectional view taken on line III—III of FIG. 2.

Referring now to the drawings in detail and in particular to FIG. 3 there is shown a portion of a circular array of curved side entry steam turbine blades 1 disposed in curved slots (not shown) in a disc 2 to form a row of rotating turbine blades. The blades 1, as shown in FIG. 1, have a curved Christmas tree-shaped root portion 3, a platform portion 5 and an airfoil portion 7, respectively, disposed radially outwardly from the root portion 3.

The platform portion 5 has four sides, an inlet side 9 on the side the steam enters the blade row, an outlet side 11 on the side the steam leaves the blade row, a forward arcuate side 13 and a rear arcuate side 15, the latter two sides being relative to the direction of rotation of the blade row.

The blades 1 are assembled on the rotor disc 2 starting with one blade and adding adjacent blades serially in one direction around the disc. Each blade 1 has a semicircular shaped notch 17 which registers with a semicircular groove 19 in the outer periphery of the disc to form an opening for receiving a key 21, which keys the blade to the disc. The next blade assembled on the disc captures the key 21, thus preventing the key 21 from coming out of the notch 17 and groove 19, thus holding the blade 1 in place on the disc 2.

Because of the curved root portion 3, there may be more than one closing blade or last blade assembled in the array. The closing blades may have to enter the disc 2 from opposite sides in order to fit the last few blades in the array. The notch 17, groove 19 and key 21 cannot be utilized to lock the closing blades to the disc and therefore another locking device must be utilized. Such a locking device comprises a through hole 23 extending through the platform 5 of the closing blades. The through hole 23 enters the platform from the outlet side 11 and extends therethrough to the rear arcuate side 15. A blind hole 25 is disposed in the forward arcuate side of the platform in the adjacent blade so that the holes 23 and 25 are aligned or registered in order to receive a pin 27. The through hole 23 has a counterbore 29 disposed on the exit side of the platform and the pin 27 has two shoulders providing three different diameters. A first diameter 31 fits tightly into the counterbore 29, a second smaller diameter 33 fits tightly into the through hole 23, and a third and smallest diameter 35 fits loosely into the blind hole 25. The diameter 35 and length of the smaller diameter portion of the pin 27 is such that there is clearance all the way around, between the end of the pin portion 35 and the blind hole 25, whereby the closing blades are locked in place on the disc and are allowed to vibrate independently of each other. A portion of the platform adjacent the counterbore 29 is upset or peened as indicated at 37 to cooperate with the step and counterbore to capture the pin in the through hole 23.

Each closing blade and the adjacent blade away from the direction of rotation of the blade row has the holes 23 and 25 and pin 27 to lock the blades in place to provide redundant locking of the closing blades.

The closing blade locking system hereinbefore described advantageously provides redundant locking of the closing blades and allows the individual blades to vibrate independently of each other.

What is claimed is:

1. A locking pin system for locking a plurality of free standing closing blades disposed in a circular array of curved side entry steam turbine blades disposed in a disc to form a row of rotating blades having curved root portions which are slidably received by the curved slots in the disc and each blade has a platform portion and an air foil portion respectively disposed radially outwardly from the root portion, the platform portion of each blade having four sides, an inlet side, on the side of the platform the steam enters the blade row, an outlet side on the side the steam exits the blade row, a forward arcuate side and a rear arcuate side, the latter two arcuate sides being relative to the direction of rotation of the blade row, the closing blade locking pin system comprising:

a plurality of closing blades with curved roots having a through hole extending through the platform portion thereof at an angle from the outlet side of the platform portion to the rear arcuate side of the platform portion;

all platforms adjacent the rear arcuate side of a platform which has a through hole in the platform portion having a blind hole disposed in the forward arcuate side;

the through hole and the blind hole being aligned when the closing blades are properly disposed in the curved slots in the disc;

a pin fitting tightly into the through hole of each closing blade and loosely into the blind hole in the adjacent blade platform with clearance on all sides of the pin in the blind hole to allow the adjacent blades to vibrate independently and yet prevent the closing blades from sliding out of the curved slots in the disc; and means for locking the pin in the through hole in each closing blade, whereby the closing blades are locked into the blade row utilizing pins, which only engage the blade platforms.

2. A locking pin system as set forth in claim 1, wherein a blade adjacent the forward arcuate side of the platform of the forward closing blade relative to the direction of rotation of the blade row has a through hole extending through the platform at an angle from the outlet side of the platform to the rear arcuate side thereof and the adjacent closing blade platform has a blind hole disposed therein aligned with the through hole, when the respective blades are properly disposed in the curved slots in the disc, and a pin fitting tightly into the through hole and loosely into the blind hole in the respective blades.

3. A locking pin system as set forth in claim 1, wherein the means for locking the pin in the through hole comprises a counterbore in the through hole adjacent the outlet side of the platform, a shoulder on the pin to fit the counterbore and an upset in the platform adjacent the counterbore to capture the pin in the through hole.

4. A locking pin system as set forth in claim 3, wherein the pin has a round cross-section and three different diameters which decrease serially.

* * * * *